United States Patent [19]

Ishihara et al.

[11] 4,347,296

[45] Aug. 31, 1982

[54] ELECTROPHOTOGRAPHIC PHOTOSENSITIVE MEMBER AND ELECTROPHOTOGRAPHIC PROCESS

[75] Inventors: Shunichi Ishihara, Kodaira; Nobuo Kitajima, Toride; Yuji Nishigaki, Kawasaki; Nobuko Kitahara, Tokyo, all of Japan

[73] Assignee: Canon Kabushiki Kaisha, Tokyo, Japan

[21] Appl. No.: 201,479

[22] Filed: Oct. 28, 1980

[30] Foreign Application Priority Data

Nov. 1, 1979 [JP] Japan ..... 54-142305

[51] Int. Cl.[3] ..... G03G 13/01; G03G 5/14

[52] U.S. Cl. ..... 430/42; 430/31; 430/46; 430/60; 430/63; 430/66

[58] Field of Search ..... 430/31, 42, 46, 60, 430/63, 66

[56] References Cited

U.S. PATENT DOCUMENTS

| | | | |
|---|---|---|---|
| 2,917,385 | 12/1959 | Byrne | 430/63 |
| 3,005,707 | 10/1961 | Kallmann et al. | 430/63 X |
| 3,226,307 | 12/1965 | Tokumoto | 430/46 X |
| 3,413,117 | 11/1968 | Gaynor | 430/42 X |
| 3,717,460 | 2/1973 | Duck et al. | 430/66 |
| 3,836,363 | 9/1974 | Plutchok | 430/46 |
| 3,941,593 | 3/1976 | Butement | 430/66 X |

*Primary Examiner*—Roland E. Martin, Jr.

*Attorney, Agent, or Firm*—Fitzpatrick, Cella, Harper & Scinto

[57] ABSTRACT

An electrophotographic photosensitive member comprises isolated conductive members forming picture elements, a photoconductive layer, transparent electrodes and color filter electrodes. Also, a color electrographic process which comprises applying voltage between a transparent electrode and color filter electrode of an electrophotographic photosensitive member comprising isolated conductive members forming picture elements, a photoconductive layer, transparent electrodes and color filter electrodes, conducting imagewise exposure from the side opposite to the side where the isolated conductive members are arranged, resulting in formation of difference in distribution voltage between the area that light passes through the color filter electrode and the area that light does not pass through the color filter electrode with regard to the voltage distribution between the transparent electrode and the isolated conductive member and between the color filter electrode and the isolated conductive member, thereby forming a voltage image depending upon the change of voltage of the isolated conductive member produced corresponding to the difference in the distribution voltage, and developing said voltage image with a color toner corresponding to a color light passing through the color filter electrode.

8 Claims, 9 Drawing Figures

ELECTROPHOTOGRAPHIC PHOTOSENSITIVE MEMBER AND ELECTROPHOTOGRAPHIC PROCESS

BACKGROUND OF THE INVENTION

1. Field of the Invention

The present invention relates to an electrophotographic photosensitive member and an electrophotographic process.

2. Description of the Prior Art

According to conventional methods for forming colored images by means of an electrophotographic photosensitive member, original colored images are exposed at least three times and the exposure is effected through a color filter which is usually a red, green or blue filter. After each exposure, the latent images are developed with a toner whose color is a complementary color to the color of the filter to produce toner image according to an electrophotographic process.

For example, a photosensitive member is charged, imagewise exposed through a red filter, developed with a cyan toner and the image thus developed is transferred to a receiving paper and then the same procedure is repeated by using a green filter and a blue filter followed by developing with a magenta toner and a yellow toner, respectively, to produce colored images. When a black toner is used for an additional image forming step for improving image quality of colored images, a somewhat more intensive exposure is effected without using a color filter and a black toner is attached electrostatically to the surface of the photosensitive member corresponding to black portions of the original images.

As mentioned above, conventional colored image formation by electrophotographic means needs three exposures with different filters and the procedures are complicated. Further, in conventional methods, between the three exposures and developments there are effected corona chargings, but in case of corona charging, it is, in general, very difficult to control the electric charge amount. Therefore, control of the tone of color images is effected by adjusting the exposure amount. Such a way of controlling the tone can not be easily effected at a high accuracy, and further, it is more difficult to control each color tone separately.

This application is related to U.S. Ser. No. 204,286, by the same inventors, filed Nov. 5, 1980.

SUMMARY OF THE INVENTION

It is an object of the present invention to provide an electrophotographic photosensitive member which can easily control the total tone of colored images formed by electrode voltages and individually control each color tone, and a color electrophotographic process using said photosensitive member.

It is another object of the present invention to provide a color electrophotographic photosensitive member which does not need corona charging for forming color images and a color electrophotographic process using said photosensitive member.

It is a further object of the present invention to provide an electrophotographic photosensitive member which can form black portions of colored images by attaching only a black toner thereto and a color electrophotographic process.

According to one aspect of the present invention, there is provided an electrophotographic photosensitive member which comprises isolated conductive members forming picture elements, a photoconductive layer, transparent electrodes and color filter electrodes.

According to another aspect of the present invention, there is provided a color electrographic process which comprises:

applying voltage between a transparent electrode and a color filter electrode of an electrophotographic photosensitive member comprising isolated conductive members forming picture elements, a photoconductive layer, transparent electrodes and color filter electrodes, conducting imagewise exposure from the side opposite to the side where the isolated conductive members are arranged, resulting in formation of a difference in distribution voltage between the area wherein light passes through the color filter electrode and the area wherein light does not pass through the color filter electrode with regard to the voltage distribution between the transparent electrode and the isolated conductive member and between the color filter electrode and the isolated conductive member, thereby forming a voltage image depending upon the change of voltage of the isolated conductive member produced corresponding to the difference in the distribution voltage, and developing said voltage image with a color toner corresponding to a color light passing through the color filter electrode.

BRIEF DESCRIPTION OF THE DRAWINGS

FIG. 4 represents the developing step by black toner, FIG. 5 the developing step by cyan toner, FIG. 6 the developing step by magenta toner, and FIG. 7 the developing step by yellow toner, representatively.

DESCRIPTION OF THE PREFERRED EMBODIMENTS

Figure 1:
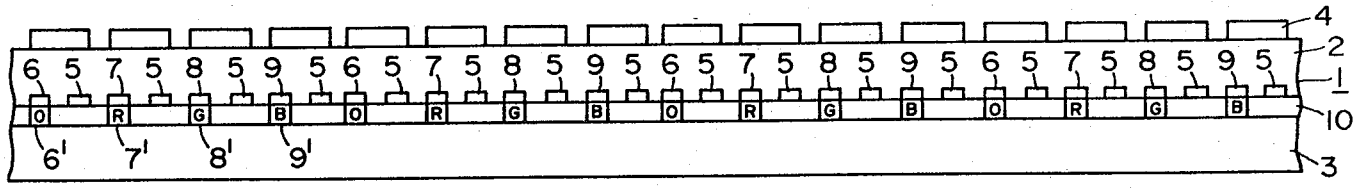
FIGS. 1, 8 and 9 show embodiments of the electrode according to the present invention, respectively.

Referring to FIG. 1 showing one of the representative embodiments of the photosensitive member of the present invention, the photosensitive member 1 is composed of substrate 3, filter layer 10, electrode-photoconductive layer 2 and isolated conductive member 4.

As electrodes, there are provided periodically at regular intervals transparent electrode 5, opaque electrode 6 having opaque filter 6', red filter electrode 7 having red filter 7', green filter electrode 8 having green filter 8', and blue filter electrode 9 having blue filter 9'. Substrate 3 is transparent and is made of glass, resin or the like.

Filter layer 10 having opaque filter 6', red filter 7', green filter 8' and blue filter 9' may be prepared by a process similar to that for producing conventional color filters. For example, a vapor deposition process and a coloring process are representative ones.

According to the vapor deposition method, a color filter is produced by using an interference filter. Thus, films having different refractive indices are vapor-deposited on a substrate through a mask in a predetermined thickness to form a multi-layer so as to allow a light of a desired wavelength region (color) to be transmitted by the interference effect of the light. Thus, red, green and blue filters can be produced. Opaque filters can be produced by vapor-depositing or coating a metal such as Al, Ag, Pb, Ni, Au and the like or a black dye.

The coloring process comprises the following steps. To a substrate is applied a resin such as poly(vinyl alcohols), gelatin, polyurethanes, polycarbonates and the like to form a dye-acceptable layer. Dyes are added to the layer to form a filter layer. In order to form each opaque, red, green and blue filter, a mask is usually formed by using photoresists on the surface of the dye-acceptable layer, then one color of dyes is added to the predetermined portion by the mask, and thereafter the mask is removed by etching. The foregoing step is repeated to form the foregoing filters.

The following dyes are representative dyes for preparing colored filters.

(1) Acceptable sublimable red dyes: Celliton Scarlet B (supplied by BASF), Diacelliton Fast Pink R (supplied by Mitsubishi Chemical Industrial Ltd.), Terasil Brilliant Pink 4BN (supplied by Ciba-Geigy Ltd.), Kayalon Red R (supplied by Nippon Kayaku Co. Ltd.), Sumikaron Red E-FBL (supplied by Sumitomo Chemical Co. Ltd.), Resolin Red FB (supplied by Bayer AG.), Sumiacryl Rhodamine 6GCP (supplied by Sumitomo Chemical Co. Ltd.), Aizen Cathilon Pink FGH (supplied by Hodogaya Chemical Co. Ltd.), Maxilon Brilliant Red 4G (supplied by Ciba-Geigy Ltd.), Diacryl Supra Brilliant Pink RN (supplied by Mitsubishi Chemical Industrial Ltd.) and the like.

Acceptable red dyes for application:

Suminol Fast Red B conc. (supplied by Sumitomo Chemical Co. Ltd.), Aizen Brilliant Scarlet 3RH (supplied by Hodogaya Chemical Co. Ltd.), Azo Rubinol 3GS 250% (supplied by Mitsubishi Chemical Industrial Ltd.), Kayaku Acid Rhodamine FB (supplied by Nippon Kayaku Co. Ltd.), Acid Anthracene Red 3B (supplied by Chuhgai Chemical Co. Ltd.), Benzil Fast Red B (supplied by Ciba-Geigy Ltd.), Palatine Fast Red RN (supplied by BASF), Nylomine Red 2BS (supplied by I.C.I. Ltd.), Lanafast Red 2GL (supplied by Mitsui-Toatsu Chemicals Inc.), Rose Bengal (supplied by Kii Chemical Industry Ltd.) and the like.

(2) Acceptable sublimable green dyes: Aizen Diamond Green GH (supplied by Hodogaya Chemical Co. Ltd.), Aizen Malachite Green (supplied by Hodogaya Chemical Co. Ltd.), Brilliant Green (supplied by E. I. du Pont de Nemours & Co. Inc.), Fast Green JJO (supplied by Ciba-Geigy Ltd.), Synacril Green G (supplied by I.C.I. Ltd.), Victoria Green (supplied by E. I. du Pont de Nemours & Co. Ltd.) and the like.

Acceptable green dyes for application: Kayakalan Blue-Black 3BL (supplied by Nippon Kayaku Co. Ltd.), Sumilan Green BL (supplied by Sumitomo Chemical Co. Ltd.), Aizen Floslan Olive Green GLH (supplied by Hodogaya Chemical Co. Ltd.), Diacid Cyanine Green GWA (supplied by Mitsubishi Chemical Industrial Ltd.), Cibalan Green GL (supplied by Ciba-Geigy Ltd.), Carbolan Brilliant Green 5G (supplied by I.C.I. Ltd.), Palatine Fast Green BLN (supplied by BASF), Acid Green GBH (supplied by Takaoka Chemical Co. Ltd.), Acid Brilliant Milling Green B (supplied by Mitsui-Toatsu Chemicals Inc.) and the like.

Also, green can be produced by incorporation of blue and yellow dyes.

(3) Acceptable sublimable blue dyes: Miketon Fast Blue Extra (supplied by Mitsui-Toatsu Chemical Inc.), Kayalon Fast Blue FN (supplied by Nippon Kayaku Co. Ltd.), Sumikaron Blue E-BR (supplied by Sumitomo Chemical Co. Ltd.), Terasil Blue 2R (supplied by Ciba-Geigy Ltd.), Palanil Blue R (supplied by BASF), Aizen Brilliant Basic Cyanine 6GH (supplied by Hodogaya Chemical Co. Ltd.), Aizen Cathilon Blue GLH (supplied by Hodogaya Chemical Co. Ltd.), Cibacet Blue F3R (supplied by Ciba-Geigy Ltd.), Diacelliton Fast Brilliant Blue B (supplied by Mitsubishi Chemical Industrial Co. Ltd.), Dispersol Blue BN (supplied by I.C.I. Ltd.), Resolin Blue FBL (supplied by Bayer A.G.), Latyl Blue FRN (supplied by E. I. du Pont de Nemours & Co. Inc.), Sevron Blue ER (supplied by E. I. du Pont de Nemours & Co. Ltd.), Diacryl Brilliant Blue H2R-N (supplied by Mitsubishi Chemical Industrial Co. Ltd.) and the like.

Acceptable blue dyes for application: Orient Soluble Blue OBC (supplied by Orient Chemical Co. Ltd.), Suminol Leveling Blue 4GL (supplied by Sumitomo Chemical Co. Ltd.), Kayanol Blue N2G (supplied by Nippon Kayaku Co. Ltd.), Mitsui Alizarine Saphirol B (supplied by Mitsui-Toatsu Chemicals Inc.), Xylene Fast Blue BL 200% (supplied by Mitsubishi Chemical Industrial Co. Ltd.), Alizarine Fast Blue R (Supplied by CibaGeigy Ltd.), Carbolan Brilliant Blue 2R (supplied by I.C.I. Ltd.), Palatine Fast Blue GGN (supplied by BASF), Aizen Opal Blue New conc. (supplied by Hodogaya Chemical Co. Ltd.), Fastogen Blue SBL (supplied by Dainihon Ink Chemical Co. Ltd.) and the like.

Acceptable black dyes: Suminol Fast Black BR conc. (supplied by Sumitomo Chemical Co. Ltd.), Diacelliton Fast Black T (supplied by Mitsubishi Chemical Industrial Ltd.), Miketazol Black 3GF (supplied by Mitsui-Toatsu Chemicals Inc.), Kayalon Diazo Black 2GF (supplied by Nippon Kayaku Co. Ltd.), and Aizen Opal Black WGH (supplied by Hodogaya Chemical Co. Ltd.) and the like.

All the above-mentioned names represent trade names. Transparent electrodes 5 are formed by the following step. On the filter layer are deposited, by vacuum evaporation, materials for transparent electrodes, for example, $In_2O_3$, $SnO_3$, In-Sn-O etc., or metals such as Au, Cu and the like in a thin film state. Thereafter, a comb shape of masking pattern is formed by using photoresists, then the layer of $In_2O_3$ etc. is selectively removed by using the predetermined etching agents such as acids or alkalis, and the masking pattern of the photoresists is removed to form a transparent electrode. Electrodes 6–9 are also formed in a similar manner as described above.

Materials which are already generally used for photoresist can be used as photoresist for forming color filters and electrodes. For example, the following are commercially available: KPR (trade name, Kodak Photo Resist; supplied by Kodak . . . developer: methylenechloride, trichlene etc.) KMER (trade name, Kodak Metal Etch Resist; supplied by Kodak . . . developer: xylene, trichlene etc.), TPR (trade name; supplied by Tokyo Ohka . . . developer: xylene, trichlene etc.), Shipley AZ 1300 (trade name; supplied by Shipley . . . developer: alkali aqueous solution), KTFR (trade name, Kodak Thin Film Resist; supplied by Kodak . . . developer: xylene, trichlene etc.), FNRR (trade name; supplied by Fuji Yakuhin Kogyo Co. Ltd. . . . developer; chlorcene), FPER (trade name, Fuji Photo Etching Resist; supplied by Fuji Photo Film Co. Ltd. . . . developer: trichlene), TESH DOOL (trade name; supplied by Okamoto Chemical Industrial Co. Ltd. . . . developer: water), Fuji-Resist No. 7 (trade name; supplied by Fuji Yakuhin Kogyo Co. Ltd. . . . developer; water), and the like. Further, there are used trichlene, methylene chloride, AZ Remover (trade name; supplied by Shipley), sulfuric acid and the like for removing the used mask.

Each electrode can be formed by removing a mask, after an electrode forming material is deposited by vacuum evaporation on a substrate through the mask having an opening of a comb shape.

The electrodes may be usually formed about 500 Å~6000 Å in thickness.

Figure 2:
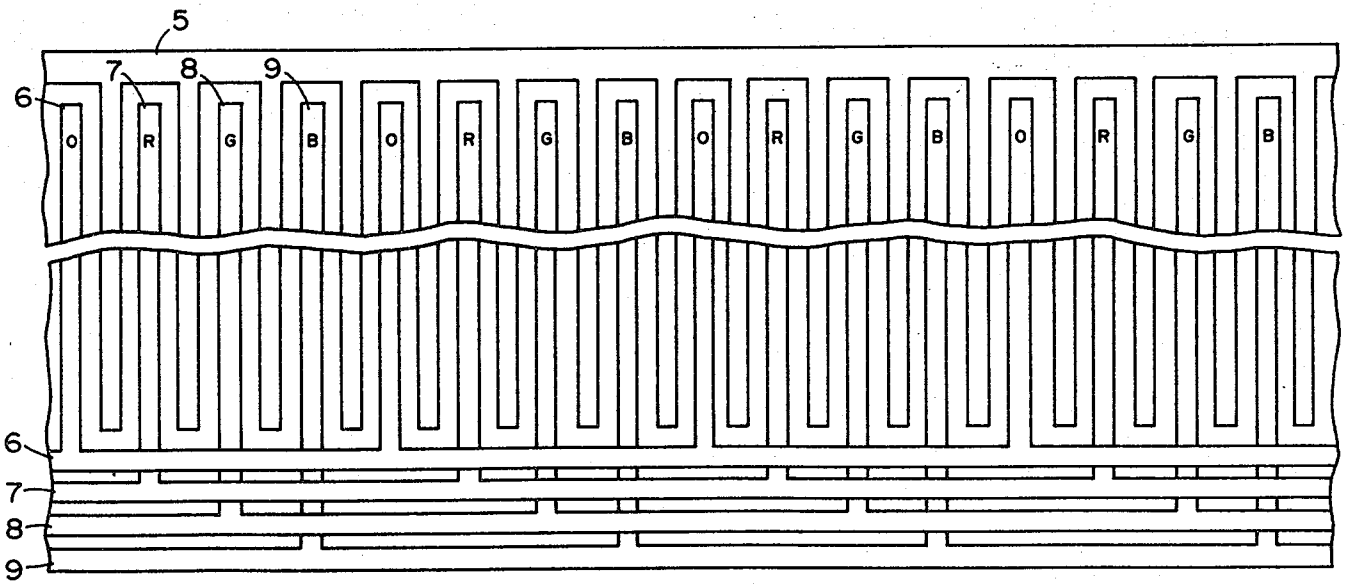
FIG. 2 is a plan view of the electrode pattern of the electrophotographic photosensitive member shown in FIG. 1.

Electrodes formed on portions in which colored filters are not formed act as transparent electrodes 5, electrodes formed on opaque filters 6, act as opaque electrodes 6, electrodes formed on red filters 7, act as red filter electrodes 7, electrodes formed on green filters 8, act as green filter electrodes 8, and electrodes formed on blue filter 9, act as blue filter electrodes 9, respectively. FIG. 2 is a plan view of the thus obtained color filter electrodes having a comb shape.

Portions in which the opaque electrodes 6, the red filter electrodes 7, the green filter electrodes 8, and the blue filter electrodes 9 overlap oppositely with transparent electrodes 5, respectively, are formed in an electrically insulated state (for example, insulating points are laid between the transparent electrodes and other electrodes).

A photoconductive layer 2 is formed by vacuum evaporation of inorganic photoconductive materials such as S, Se, PbO, alloys containing S, Se, Te, As, Sb and the like and intermetallic compounds. Also, in case of forming the photoconductive layer by a sputtering process, the photoconductive layer may be formed on a substrate by adhesion of photoconductive materials having high melting points such as ZnO, CdS, CdSe, $TiO_2$ and the like.

In case of forming the photoconductive layer by coating, there may be used organic photoconductive materials such as poly (vinyl carbazole), anthracene, phthalocyanine and the like, said materials being sensitized by coloring materials or Lewis acids, and mixtures thereof with insulating binders. Also, there may be used a mixture of insulating binders and inorganic photoconductive materials such as ZnO, CdS, $TiO_2$, PbO and the like. Various resins can be used as an insulating binder. Thickness of the photoconductive layer is dependent upon the type and characteristics of the photoconductive material to be used. The thickness is generally 5–100 microns, preferably about 10–50 microns.

Isolated conductive members 4 are discontinuous island conductive members and important conductive members constructing picture elements of an image to be formed. The shape of the isolated conductive members is square, as shown in the plan view of FIG. 3. The isolated conductive members can be formed by the same manner as that described on color filter.

A process for forming colored images by utilizing the photoconductive member according to the present invention comprises the following steps. Voltage is applied between the transparent electrodes and the opaque electrodes, and image-exposure is carried out from the side of the opaque electrodes, that is, from the side opposite to the side where the isolated conductive members are arranged. Thereby, a difference in voltage occurs between the area wherein light passes through the transparent electrodes and the area wherein light does not pass through, with regard to voltage distribution between the transparent electrodes and the isolated conductive member and between the isolated conductive member and the opaque electrode. A potential image formed by change of potential of the isolated conductive members corresponding to change in the voltage distribution is developed by a black developer. Further, voltage is applied between the transparent electrodes and the color filter electrodes, and image-exposure is carried out from the side of the color filter electrodes. Thereby, a difference in voltage occurs between the area wherein light passes through the color filter electrodes and the area wherein light does not pass through, with regard to voltage distribution between the transparent electrode and the isolated conductive member and between the isolated conductive member and the color filter. A potential image formed by change of potential of the isolated conductive members corresponding to the difference of the voltage distribution is developed by a color developer corresponding to the color of the light passed through the color filter electrodes. The developing step by the black developer may be omitted.

A representative process for producing colored images by using a photosensitive member as illustrated in FIG. 1 is shown in FIGS. 4–7.

STEP 1

Voltage Va is applied between electrodes 5 and 6. Electrode 5 is earthed. At this stage a light from the original image 11 is projected to the photosensitive member. Photosensitive layer 2 positioned above electrode 6 is always dark because the portion of photosensitive layer 2 is intercepted from light by opaque filter 6' and the portion of photoconductive layer 2 between electrode 6 and isolated conductive member 4 is at a dark state. The resistance at this state is designated as $R_6$(dark). The portion of photoconductive layer 2 above transparent electrode 5 corresponding to a black light (i.e. no incident light), that is, corresponding to the black portion of the original image, is at a dark state and the resistance between electrode 5 and isolated conductive member 4 is represented by $R_5$(black.dark).

On the contrary, at portions corresponding to white, red, green, and blue of the original image ("white" is not shown here, nor is "white" shown hereinafter). The portion of photoconductive layer 2 above transparent electrode 5 shows the following resistance at a light state, that is, the resistance between electrode 5 and isolated conductive electrode 4 is designated as $R_5$(white.light), $R_5$(red.light), $R_5$(green. light) and $R_5$(blue.light), respectively.

Voltage Vo formed in isolated conductive member 4 corresponding to a black portion of the original image is as shown below:

$$Vo = \frac{R_5(\text{black} \cdot \text{dark})}{R_5(\text{black} \cdot \text{dark}) + R_6(\text{dark})} Va$$

In a simple case, that is, a case where structure, area and the like of electrodes 5 and 6 are the same, $R_5$(black.dark)=$R_6$(dark). Therefore, Vo of isolated conductive member is $\frac{1}{2}$Va.

When the intensity of projected light is sufficient, it is very easy in the case of ordinary photoconductive material to decrease the resistance of the photoconductive layer upon light projection to a resistance lower than that at a dark state by three digits, regardless of the kind of color, i.e. white, red, green and blue.

Therefore, any of $R_6(\text{dark})/R_5(\text{white.light})$, $R_6(\text{dark})/R_5(\text{red.light})$, $R_6(\text{dark})/R_5(\text{green.light})$, $R_6(\text{dark})/R_5(\text{blue.light})$ can be $>10^3$.

Figure 4:
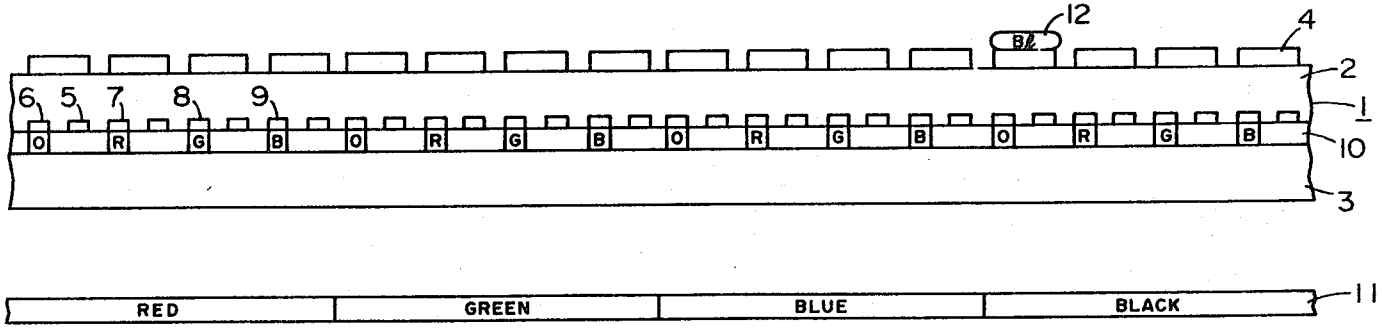
FIGS. 4–7 show diagrammatically the color electrophotographic process according to the present invention.

Under these conditions, voltage Vo produced at an isolated conductive member corresponding to white, red, green or blue portion of the original image is Voδ0. At this stage, when development is conducted with a black toner of an opposite polarity to the voltage Vo, black toner 12 attaches only to an isolated conductive member corresponding to a black portion of the projected light image as shown in FIG. 4.

When the resulting black toner image is transferred to a receiving paper, there is reproduced a black image corresponding to the black portion of the projected image.

STEP 2

Then, voltage Va is applied between electrodes 5 and 7. Electrode 7 is assumed to be earthed. This Va may or may not be the same as Va in step 1. Then a light image from the original is projected. When no light is projected from the black portion of the original, no light comes to the portion of photoconductive layer 2 above electrode 7 and the above electrode 5 and, therefore, a dark state is formed. Resistance between electrode 7 and isolated conductive member 4 is $R_7(\text{black.dark})$ and resistance between electrode 5 and isolated conductive member 4 is $R_5(\text{black.dark})$.

Thus, voltage Vo formed in the isolated conductive member 4 is as follows:

$$V_o = \frac{R_7(\text{black}\cdot\text{dark})}{R_7(\text{black}\cdot\text{dark}) + R_5(\text{black}\cdot\text{dark})} V_a$$

When structures, areas and the like of electrodes 7 and 5 are the same, voltage Vo at the isolated conductive member is $V_o = \frac{1}{2}V_a$.

When white light and red light are projected (that is, in the case of white portion and red portion of the original image), light is projected on both a portion of photoconductive layer 2 above electrode 7 and the above electrode 5 and, therefore, there is a light state. Resistance between electrode 7 and isolated conductive member 4 is $R_7(\text{red.light})$ and resistance between electrode 5 and isolated conductive member 4 are $R_5$ (white.light) and $R_5(\text{red.light})$.

When intensity of the light is high and the photoconductive layer is sufficiently photoconductive, it appears that $R_7(\text{red.light}) = R_5(\text{white.light}) = R_5(\text{red.light}) = R_5(\text{light})$.

Therefore, voltage at the isolated conductive members corresponding to white portion and red portion of the original image, $$V_o = \frac{R_7(\text{light})}{R_7(\text{light}) + R_5(\text{light})} V_a$$

thus $V_o = \frac{1}{2}V_a$

Apart from the above, when green light and blue light are projected (that is, in the case of green portion and blue portion of the original image), the lights are intercepted by red filter 7' and thereby, do not reach the portion of photoconductive layer 2 above electrode 7 and it is a dark state. Therefore, resistance between electrode 7 and isolated conductive member 4 is $R_7(\text{dark})$. On the other hand, the portion of photoconductive layer 2 above electrode 5 is irradiated and becomes a light state, and resistance between electrode 5 and isolated conductive member 4 is $R_5(\text{light})$.

As a result, voltage Vo at the isolated conductive members corresponding to green portion and blue portion is as shown below:

$$V_o = \frac{R_7(\text{dark})}{R_7(\text{dark}) + R_5(\text{light})} V_a$$

When the photoconductive characteristic is more than three digits, $R_7(\text{dark})/R_5(\text{light}) > 10^3$ and therefore, $V_o \simeq V_a$.

Figure 5:
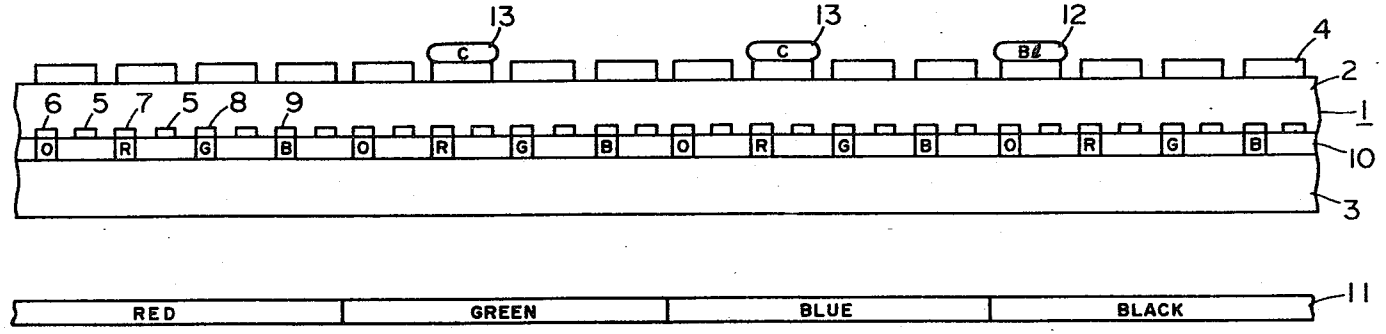

Under these conditions, when development is effected with a transparent cyan toner of an opposite polarity to that of voltage Va, cyan toner 13 attaches only to isolated conductive members corresponding to green and blue portions of the original image as shown FIG. 5.

When the developed images are transferred to the paper having a black toner image transferred in STEP 1, toner images are produced corresponding to black and cyan portions of the original image.

STEP 3

Then, voltage Va is applied between electrodes 8 and 5. Electrode 8 is earthed. The value Va may or may not be the same as Vo at STEP 1 and STEP 2. While voltage is applied, a light from the original image is projected, and when there is no projection of a black light, that is, projection of a light corresponding to a black portion of the original image, neither the portion of photoconductive layer 2 corresponding to electrode 8 nor that corresponding to electrode 5 is irradiated so that it is a dark state, and resistance between electrode 8 and isolated conductive member 4 is $R_8(\text{dark})$. Therefore, voltage Vo at the isolated conductive member 4 corresponding to the black portion of the original image is as shown below:

$$V_o = \frac{R_8(\text{dark})}{R_8(\text{dark}) + R_5(\text{dark})} V_a$$

When structures, areas and the like of electrodes 8 and 5 are the same, $V_o = \frac{1}{2}V_a$.

Then, when white light and green light are projected (in the case of white and green portions of the original image), the portion of photoconductive layer 2 above electrode 8 and that above electrode 5 are irradiated and are at a light state, and resistance between electrode 8 and isolated conductive member 4 appears to be $R_8(\text{light})$ while resistance between electrode 5 and the isolated conductive member 4 is $R_5(\text{white.light})$ and $R_5(\text{green.light})$. When structures of electrodes 8 and 5 are the same and light intensity is high and the photoconductive layer has a sufficient photoconductivity, it appears that $R_8(\text{light}) = R_5(\text{white.light}) = R_5(\text{green.light}) = R_5(\text{light})$.

Therefore, voltage at isolated conductive members 4 corresponding to the white portion and green portion of the original image is as shown below:

$$V_o = \frac{R_8(\text{light})}{R_8(\text{light}) + R_5(\text{light})} V_a$$

and thus, $Vo=\frac{1}{2}Va$.

Then, when red and blue lights are projected (in case of red and blue portions of the original image), the green filter intercepts the lights so that the portion of photoconductive layer 2 above electrode 8 is not irradiated and is at a dark state. Resistance betweeen electrode 8 and isolated conductive member 4 is $R_8$(dark).

On the other hand, the portion of photoconductive layer 2 above electrode 5 is irradiated and becomes a light state, and resistance between electrode 5 and isolated conductive member 4 becomes $R_5$(light).

Therefore, voltage Vo formed at the isolated conductive members corresponding to the red and blue portions of the original image is:

$$Vo = \frac{R_8(\text{dark})}{R_8(\text{dark}) + R_5(\text{light})} Va$$

and when the photoconductive characteristics are more than three digits, there is a relation, i.e., $R_8(\text{dark})/R_5(\text{light}) > 10^3$, and the result is $Vo \simeq Va$.

Figure 6:
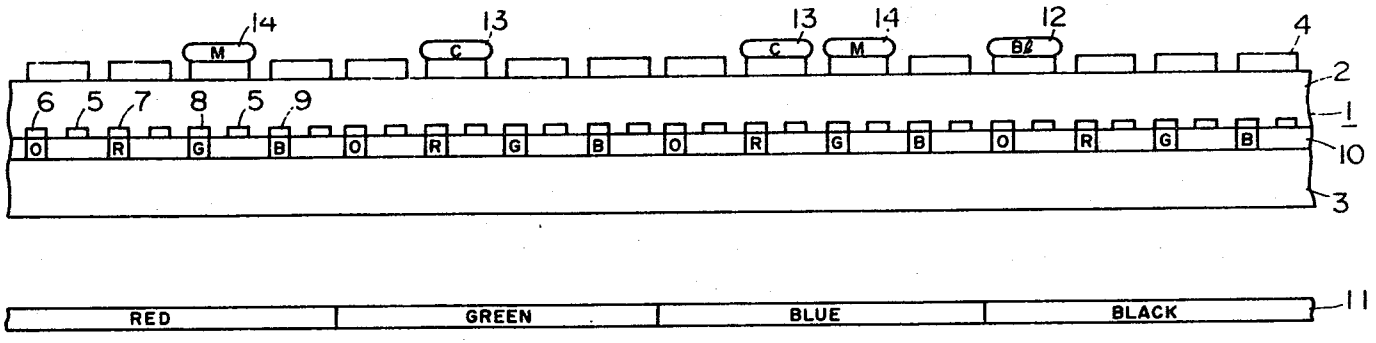

Under these conditions, when development is effected with a transparent magenta toner having a polarity opposite to that of the Vo, magenta toner 14 attaches to the isolated conductive members corresponding to the red and blue portions of the original image as shown in FIG. 6.

The images thus developed are transferred to the paper having black and cyan toner images transferred in STEP 1 and STEP 2 and images are produced corresponding to black, cyan and magenta portions of the original images.

STEP 4

Voltage Va is applied between electrodes 9 and 5, and electrode 9 is earthed. The value of Va may be similar or dissimilar to that in STEP 1, 2 and 3. While voltage is applied, light from the original image is projected. When there is no projection of black color (i.e. projection of light corresponding to the black portion of the original image), the portion of photoconductive layer 2 above electrode 9 and that above electrode 5 are not irradiated and therefore, are at a dark state. Resistance between electrode 9 and isolated conductive member 4 is $R_9$(dark) and resistance between electrode 5 and isolated conductive member 4 is $R_5$(dark). Therefore, voltage Vo at an isolated conductive member 4 corresponding to a black portion of the original image is:

$$Vo = \frac{R_9(\text{dark})}{R_9(\text{dark}) + R_5(\text{dark})} Va$$

and when structures, areas and the like of electrodes 9 and 5 are the same, there is a relation, $Vo\frac{1}{2}Va$.

When white and blue lights are projected (in the case of white and blue portions of the original image), the portion of photoconductive layer 2 above electrode 9 and that above electrode 5 are irradiated and are at a light state. Resistance between electrode 9 and isolated conductive member 4 appears to be $R_9$(light) and resistance between electrode 5 and isolated conductive member 4 is $R_5$(white.light) and $R_5$(blue.light). When light intensity is high and the photoconductive layer has a sufficient photoconductivity, there appears $R_9(\text{light}) = R_5$ (white.light) $= R_5$(blue.light) $= R_5$(light). Therefore, voltage Vo formed at isolated conductive members 4 corresponding to white and blue portions is:

$$Vo = \frac{R(\text{light})}{R(\text{light}) + R(\text{light})} Va$$

and therefore, $Vo=\frac{1}{2}Va$.

Then, when green and red lights are projected (in case of green and red portions of the original image), the blue filter intercepts the light so that the portion of photoconductive layer 2 above electrode 9 is not irradiated and is at a dark state. Resistance between electrode 9 and isolated conductive member 4 is $R_9$(dark). On the other hand, the portion of photoconductive layer 2 above electrode 5 is irradiated and is at a light state, and resistance between electrode 5 and isolated conductive member 4 is $R_5$(light). Therefore, voltage Vo formed at the isolated conductive members corresponding to the green and red portions of the original image is:

$$Vo = \frac{R_9(\text{dark})}{R_9(\text{dark}) + R_5(\text{light})} Va$$

when the photoconductive characteristics are more than three digits, there is a relation, namely $R_9(\text{dark})/R_5(\text{light}) > 10^3$, and thus, $Vo \simeq Va$.

Figure 7:
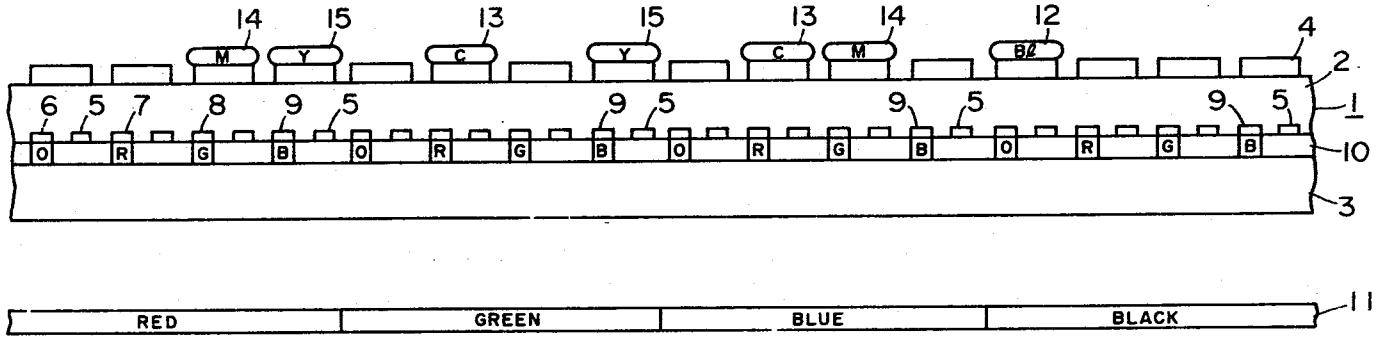

When development is effected under these conditions with a transparent yellow toner having a polarity opposite to that of the applied voltage Va, the yellow toner 15 attaches to the isolated conductive members corresponding to only the green and red portions of the original image as shown in FIG. 7.

The toner image thus developed are transferred to the paper having black, cyan and magenta toner images transferred in STEPS 1, 2 and 3 corresponding to the original image and thereby, a full color image corresponding to the original image is produced.

The table below shows a relation between voltage of the isolated conductive member and toners attaching thereto in the above process.

| Original image | STEP 1 | STEP 2 | STEP 3 | STEP 4 |
|---|---|---|---|---|
| Black | $\frac{Vo}{2}$ | $\frac{Vo}{2}$ | $\frac{Vo}{2}$ | $\frac{Vo}{2}$ |
| | Black toner attaches | | | |
| White | 0 | $\frac{Vo}{2}$ | $\frac{Vo}{2}$ | $\frac{Vo}{2}$ |
| Red | 0 | $\frac{Vo}{2}$ | Vo | Vo |
| | | | Magenta toner attaches | Yellow toner attaches |
| Green | 0 | Vo | $\frac{Vo}{2}$ | Vo |
| | | Cyan toner attaches | | Yellow toner attaches |
| Blue | 0 | Vo | Vo | $\frac{Vo}{2}$ |
| | | Cyan toner | Magenta toner | |

-continued

| Original image | STEP 1 | 2 | 3 | 4 |
|---|---|---|---|---|
| | | attaches | attaches | |

In the above table, if a toner attaches to even an isolated conductive member whose surface voltage is Va/2 and fog is formed, such disadvantage can be eliminated by a conventional method such as placing a counter electrode upon development and applying a voltage of Va/2.

The order of steps 1–4 is completely optional and the process may be started from any step.

The transfer of toner may be effected at each step, but all toners attached to the photosensitive member in steps 1–4 may be transferred at once.

If desired, the black toner attaching step in STEP 1 may be omitted and in this case, the opaque filter electrode is not necessary.

As explained above referring to the photosensitive member shown in FIG. 1, according to the process for forming colored images of the present invention, a tone of a colored image to be formed can be easily controlled by controlling a voltage applied to electrodes of a photosensitive member. In case of forming an all colored image, the image can be formed without overlying colored toners on a black toner if the black toner is used. Consequently, the registration which is necessary for transferring each colored image is easily carried out.

The photosensitive member and the color electrophotographic process according to the present invention may be further carried out by other various embodiments, as well as by the photosensitive member shown in FIG. 1 and the process comprising the foregoing steps 1–4.

Other representative embodiments will be explained below.

Figure 9:
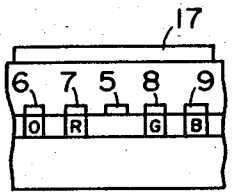
Figure 8:
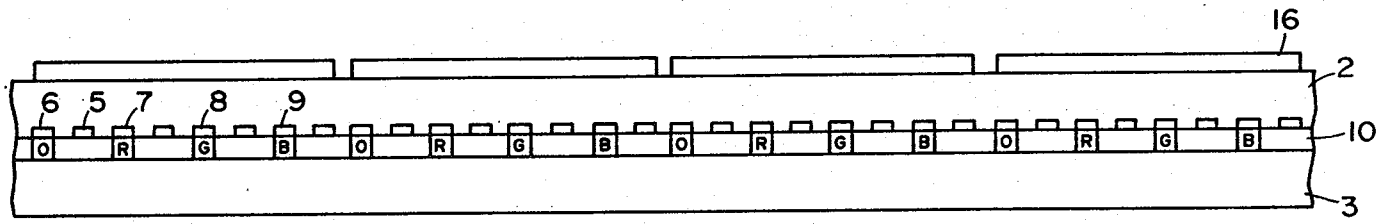

FIGS. 8 and 9 show other photosensitive members, representatively. A photosensitive member shown in FIG. 8 is provided with isolated conductive members 16 having a relatively large area so that each isolated conductive member covers a set of electrodes, that is, an opaque electrode 6, transparent electrodes 5, a red filter electrode 7, a green filter electrode 8, and a blue filter electrode 9. In case of forming a colored image by the foregoing photosensitive member, voltage is applied between each filter electrode and an isolated conductive member which is common to each filter electrode, with regard to voltage distribution between each filter electrode and the isolated conductive member, and between the transparent electrodes and the isolated conductive member. Consequently, two or more colored toners can adhere to one isolated conductive member in such a state that the colored toners are mixed. This state favors improved reproducibility of a colored image. Further, in the case of FIG. 8, opaque electrodes are present. However, in a photosensitive member where opaque electrodes are absent, it is similarly effective that each isolated conductive member is arranged in such manner that the isolated conductive member covers a set of electrodes comprising transparent electrodes and colored filter electrodes.

A photosensitive member shown in FIG. 9 represents a photosensitive member comprising one transparent electrode provided per one set of the electrodes instead of one transparent electrode provided between two colored filter electrodes. Reference numeral 17 represents an isolated conductive member. In such photoconductive member, the number of transparent electrodes is so small that production of the photosensitive member becomes simpler in proportion to the smaller number of transparent electrodes.

In the photosensitive members shown in FIGS. 1, 8 and 9, the isolated conductive member may be in other optional shapes, such as circle, hexagon and the like. Also, the shape of each electrode is not limited to a comb shape; the shape may be a dot shape whose production is rather complicated. With regard to the colored filter electrode, colored filter electrodes having no filter layer 10 shown in FIG. 1 may be formed by forming electrodes with a conductive material having filter action.

The number of types of colored filter electrodes in the photosensitive member is suitably increased or decreased depending upon the type of colored image to be formed. For example, in case a colored image is formed by copying a colored original consisting of black and red, with regard to the photosensitive member shown in FIG. 1, a photosensitive member may be used in which cyan filter electrodes which absorb only the red light of an original which is formed, instead of red filter electrodes, and it is not necessary to provide green filter electrodes and blue filter electrodes in the photosensitive member. By using such photosensitive member, development by the black toner is carried out according to the foregoing step 1, then development by a colored toner (using red toner) is carried out according to the foregoing step 2. Thereby, a colored image consisting of black and red is formed on a transfer paper by transferring the toner image thus obtained. In a similar manner as above, the red filter electrodes are replaced by magenta filter electrodes or yellow filter electrodes, thereby forming a colored image consisting of black and green, or black and blue. Further, by omitting development by a black toner there can be formed an optional colored image consisting of red and green, or green and blue.

In the color electrophotographic process according to the present invention, since voltage applied between the colored filter electrodes and the transparent electrodes is easily varied for every colored filter electrode, change of tone can be easily carried out by varying the voltage.

EXAMPLE

Gelatin was uniformly coated in the thickness of about 1 micron on a glass plate of 10 cm square, and the thus obtained gelatin layer was selectively colored by dyes of black, red, green and blue in the predetermined pattern form by means of photoresist to form a filter layer in which each colored filter of five microns wide of black, red, green and blue was arranged in parallel. The distance between two adjacent filters was 15 microns.

Then, $In_2O_3$ was deposited by vacuum evaporation at intervals of five microns and at five microns in width on the foregoing colored filters and on the space between two colored filters by a mask method. The resulting member was gradually oxidized in $O_2$ at 50° C. to form a pattern of transparent electrode. Thus, electrodes shown in FIG. 2 were produced.

Then, Se-Te alloy (Te:20% by weight) was deposited by vacuum evaporation on the $In_2O_3$ to form a photoconductive layer of 20 microns in thickness. The substrate was kept at 60° C.

Figure 3:
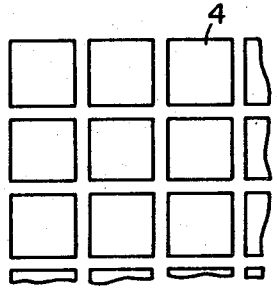
FIG. 3 is a plan view of the isolated conductive members of the electrophotographic photosensitive member shown in FIG. 1.

Then, aluminum was deposited by vacuum evaporation in the thickness of about 6000 A to form isolated conductive members as shown in FIG. 3. Thus, a photosensitive member shown in FIG. 1 was produced.

Formation of a multi-colored image was then carried out by using such photosensitive member as follows. In FIG. 4, voltage of 500 V was applied between electrodes 5 and 6 in such a manner that the side of the electrodes 5 was earthed, and a multi-colored image exposure was carried out from the side of the substrate (glass plate) by using an original having white, black, red, blue, green, cyan, magenta and yellow portions. Simultaneously, development was carried out by a magnetic brush to which negative black toner adhered so that the black toner adhered to the isolated conductive members as shown in FIG. 4.

At this time, the magnetic brush was earthed.

Then, a paper was overlaid on the isolated conductive members of the photosensitive member, and a metallic electrode was overlaid on the paper. Thereafter, a voltage of 500 V was applied to the metallic electrode, and the electrodes 5 and 6 of the photosensitive member were earthed to transfer the black toner adhering to the isolated conductive members of the photosensitive member to the paper.

Then, 500 V was applied between electrodes 5 and 7 in such a manner that the side of the electrodes 7 was earthed, and an image exposure was carried out. In this state, development was carried out by a magnetic brush on which negative cyan toner adhered so that the cyan toner only adhered to the isolated conductive members corresponding to the cyan color of the original as shown in FIG. 5, that is, the isolated conductive members corresponding to green, blue and cyan portions of the original. At this time, +250 V was applied to the magnetic brush.

Then, the foregoing paper bearing the black toner was placed at the same place on the isolated conductive members of the photosensitive member as above, and the metallic electrode was overlaid on the paper. Thereafter, 500 V was applied to the metallic electrode, and the electrodes 5 and 7 of the photosensitive member were earthed to transfer the cyan toner adhering to the isolated conductive members of the photosensitive member to the paper. Next, 500 V was applied between electrodes 5 and 8 in such a manner that the side of the electrodes 8 was earthed, and an image exposure was carried out. In this state, development was carried out by a magnetic brush on which negative magenta toner adhered so that the magenta toner only adhered to the isolated conductive members corresponding to magenta color of the original as shown in FIG. 6, that is, the isolated conductive members corresponding to red, blue and magenta portions of the original. At this time, +250 V was applied to the magnetic brush.

Thereafter, the foregoing paper bearing the black toner and the cyan toner was placed at the same place on the isolated conductive members of the photoconductive member as above, and the metallic electrode was overlaid on the paper. Thereafter, 500 V was applied to the metallic electrode, and the electrodes 5 and 8 of the photosensitive member were earthed to transfer the magenta toner adhering to the isolated conductive members of the photosensitive member to the paper.

Next, 500 V was applied between electrodes 5 and 9 in such a manner that the side of the electrodes 9 was earthed, and an image exposure was carried out. In this state, development was carried out by a magnetic brush onto which negative yellow toner adhered so that the yellow toner only adhered to isolated conductive members corresponding to the yellow color of the original as shown in FIG. 7, that is, the isolated conductive members corresponding to green, red and yellow portions of the original. At this time, +250 V was applied to the magnetic brush.

Thereafter, the foregoing paper bearing the black toner, the cyan toner, and the magenta toner was placed at the same place on the isolated conductive members of the photoconductive member as above, and the metallic electrode was overlaid on the paper. Thereafter, 500 V was applied to the metallic electrode, and the electrodes 5 and 9 of the photosensitive member were earthed to transfer the yellow toner adhering to the isolated conductive members of the photosensitive member to the paper.

The multi-colored image of the original was reproduced by the foregoing process.

Thereafter, the surface of the paper was irradiated with an infrared lamp to heat the surface at a temperature higher than 200° C. Thereby, the toners were molten to fix the toners. Since colored toners other than black are absent in the black portions, black characters are easily distinguished from other portions even by such simple registration as above.

What we claim is:

1. A color electrographic process which comprises:

applying a voltage between a transparent electrode and a color filter electrode of an electrophotographic photosensitive member comprising isolated conductive members for forming elements a substrate, and a photoconductive element therebetween, said photoconductive element having, at least one transparent electrode and color filter electrodes, conducting imagewise exposure from the substrate side, resulting in the formation of a difference in distribution voltage between the area where light passes through a color filter electrode and the area where light does not pass through a color filter electrode with regard to the voltage distribution between the transparent electrode and the isolated conductive member and between the color filter electrode and the isolated conductive member, thereby forming a voltage image depending upon the change of voltage of the isolated conductive member produced corresponding to the difference in the distribution voltage, and developing the voltage image with a color toner corresponding to the color light passing through the color filter electrode.

2. A color electrophotographic process comprising:

a step which includes applying a voltage between a transparent electrode and an opaque electrode of an electrophotographic photosensitive member comprising isolated conductive members forming picture elements, a substrate, and a photoconductive member having at least one transparent electrode, opaque electrodes and color filter electrodes, conducting imagewise exposure from the substrate side, resulting in the formation of a difference in distribution voltage between the area where light passes through the transparent electrode and the area where light does not pass through the transparent electrode with regard to the voltage distribution between the transparent electrode and the isolated conductive member and between the opaque electrode and the isolated conductive member, thereby forming a voltage image depending upon the change of voltage of the isolated conductive member produced corresponding to the difference in the distribution voltage, and developing the voltage image with a black toner; and a step which includes applying voltage between the transparent electrode and a color filter electrode, conducting imagewise exposure from the substrate side, resulting in the formation of a difference in distribution voltage between the area where light passes through the color filter electrode and the area where light does not pass through the color filter electrode with regard to the voltage distribution between the transparent electrode and the isolated conductive member and between the color filter electrode and the isolated conductive member, thereby forming a voltage image depending upon the change of voltage of the isolated conductive member produced corresponding to the difference in the distribution voltage, and developing the voltage image with a color toner corresponding to the color light passing through the color filter electrode.

3. An electrophotographic photosensitive member comprising a substrate, a plurality of isolated conductive elements forming picture elements, and an intermediate photoconductive element therebetween, said intermediate photoconductive element having at least one transparent electrode and a plurality of color filter electrodes.

4. The electrophotographic photosensitive member of claim 3, wherein said intermediate photoconductive element has a plurality of transparent electrodes.

5. The electrophotographic photosensitive member of claim 4, wherein one isolated conductive element covers a transparent electrode and a color filter electrode.

6. The electrophotographic photosensitive member of claim 4, wherein said intermediate photoconductive element further includes opaque electrodes.

7. The electrophotographic photosensitive member of claim 6, wherein one isolated conductive element covers a color filter electrode, an opaque electrode, and a transparent electrode.

8. The electrophotographic photosensitive member of claim 3, wherein said intermediate photoconductive element includes a plurality of transparent electrodes, wherein said color filter electrodes are grouped into sets, and wherein a transparent electrode is associated with each set of color filter electrodes.

* * * * *